US011867444B2

(12) United States Patent
Junge et al.

(10) Patent No.: US 11,867,444 B2
(45) Date of Patent: Jan. 9, 2024

(54) DRAINLESS CLEAR ICE MAKER FOR RECYCLING WATER USED TO MAKE CLEAR ICE

(71) Applicant: Haier US Appliance Solutions, Inc., Wilmington, DE (US)

(72) Inventors: Brent Alden Junge, Evansville, IN (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/365,861

(22) Filed: Jul. 1, 2021

(65) Prior Publication Data

US 2023/0003431 A1 Jan. 5, 2023

(51) Int. Cl.
*F25C 1/25* (2018.01)
*F25C 1/18* (2006.01)

(52) U.S. Cl.
CPC ..... *F25C 1/25* (2018.01); *F25C 1/18* (2013.01); *F25C 2400/14* (2013.01)

(58) Field of Classification Search
CPC ..... F25C 1/25; F25C 1/18; F25C 2400/14
See application file for complete search history.

(56) References Cited

U.S. PATENT DOCUMENTS

| | | | | |
|---|---|---|---|---|
| 9,719,711 | B2 | 8/2017 | Bortoletto | |
| 10,274,238 | B2 | 4/2019 | Mitchell | |
| 10,378,806 | B2 | 8/2019 | Boarman | |
| 2018/0372388 | A1* | 12/2018 | Mitchell | C02F 1/008 |
| 2022/0034570 | A1* | 2/2022 | Lee | F25B 5/04 |

FOREIGN PATENT DOCUMENTS

KR 1385852 B1 * 4/2014

OTHER PUBLICATIONS

Translated_Klm (Year: 2014).*

* cited by examiner

*Primary Examiner* — Elizabeth J Martin
*Assistant Examiner* — Samba Nmn Gaye
(74) *Attorney, Agent, or Firm* — Dority & Manning, P.A.

(57) ABSTRACT

An icemaker appliance includes a first reservoir, a second reservoir, a first circulation system associated with the first reservoir, and a second circulation system associated with the second reservoir. Liquid in the first reservoir is directed toward a first set of ice molds and liquid from the second reservoir is directed toward a second set of ice molds. Liquid in the first reservoir is selectively supplied to the second reservoir.

10 Claims, 6 Drawing Sheets

DRAINLESS CLEAR ICE MAKER FOR RECYCLING WATER USED TO MAKE CLEAR ICE

FIELD OF THE INVENTION

The present subject matter relates generally to clear ice makers, and more particularly to icemakers with no drain capable of making clear ice and recapturing the water used to make the clear ice.

BACKGROUND OF THE INVENTION

Icemaker appliances generally include an ice maker that is configured to generate ice. Ice makers within icemaker appliances are plumbed to a water supply, and water from the water supply may flow to the ice maker within the icemaker appliances. Icemaker appliances are frequently cooled by a sealed system, and heat transfer between liquid water in the ice maker and refrigerant of the sealed system generates ice.

In certain icemaker appliances, for instance, clear ice makers, water may be continually sprayed onto a chilled mold to form ice without dissolved solids which result in cloudy ice. Commonly, the icemaker appliances are plumbed to an external drain (e.g., connected to a municipal water system) to dispose of the excess water that is not frozen during an icemaking process (e.g., excess water containing dissolved solids). While effective for managing the excess water, external drain lines have drawbacks. For example, external drain lines can be expensive to install. In addition, external drain lines can be difficult to install in certain locations. Additionally, cleaning such icemaker appliances can be burdensome and time consuming.

Further, certain icemakers utilize potable municipal water in an icemaking process. This municipal water contains certain levels of Total Dissolved Solids (TDS). During some icemaking processes, only the water containing sufficiently low levels of TDS will freeze into clear ice cubes. The leftover water then contains a higher concentration of TDS, which is too high to form clear ice. Thus, leftover water remains within the icemaker, requiring removal by the user in order to continue the icemaking process.

Accordingly, an icemaker appliance with features for operating without an external drain line would be useful. In particular, an icemaker appliance that uses leftover water from a clear ice cycle would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an icemaker appliance is provided. The icemaker appliance may define a vertical direction, a lateral direction, and a transverse direction. The icemaker appliance may include a cabinet forming an ice storage compartment; a first ice mold and a second ice mold provided above the ice storage compartment; a first reservoir provided within the ice storage compartment; a first circulation system provided in the first reservoir, the first circulation system configured for supplying liquid from the first reservoir to the first ice mold; a second reservoir provided within the ice storage compartment, the second reservoir being in fluid communication with the first reservoir; and a second circulation system provided in the second reservoir. The second circulation system may be configured for supplying liquid from the second reservoir to the second ice mold.

In another exemplary aspect of the present disclosure, an icemaker appliance is disclosed. The icemaker appliance may define a vertical direction, a lateral direction, and a transverse direction. The icemaker appliance may include a cabinet forming an ice storage compartment; an ice maker provided above the ice storage compartment, the ice maker comprising a plurality of ice molds; a first reservoir provided within the ice storage compartment; a circulation system provided in the first reservoir, the circulation system configured for supplying liquid from the first reservoir to the plurality of ice molds; and a second reservoir provided within the ice storage compartment. The second reservoir may be in fluid communication with the first reservoir. The second reservoir may be divided into pockets for freezing excess liquid supplied from the first reservoir to the second reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
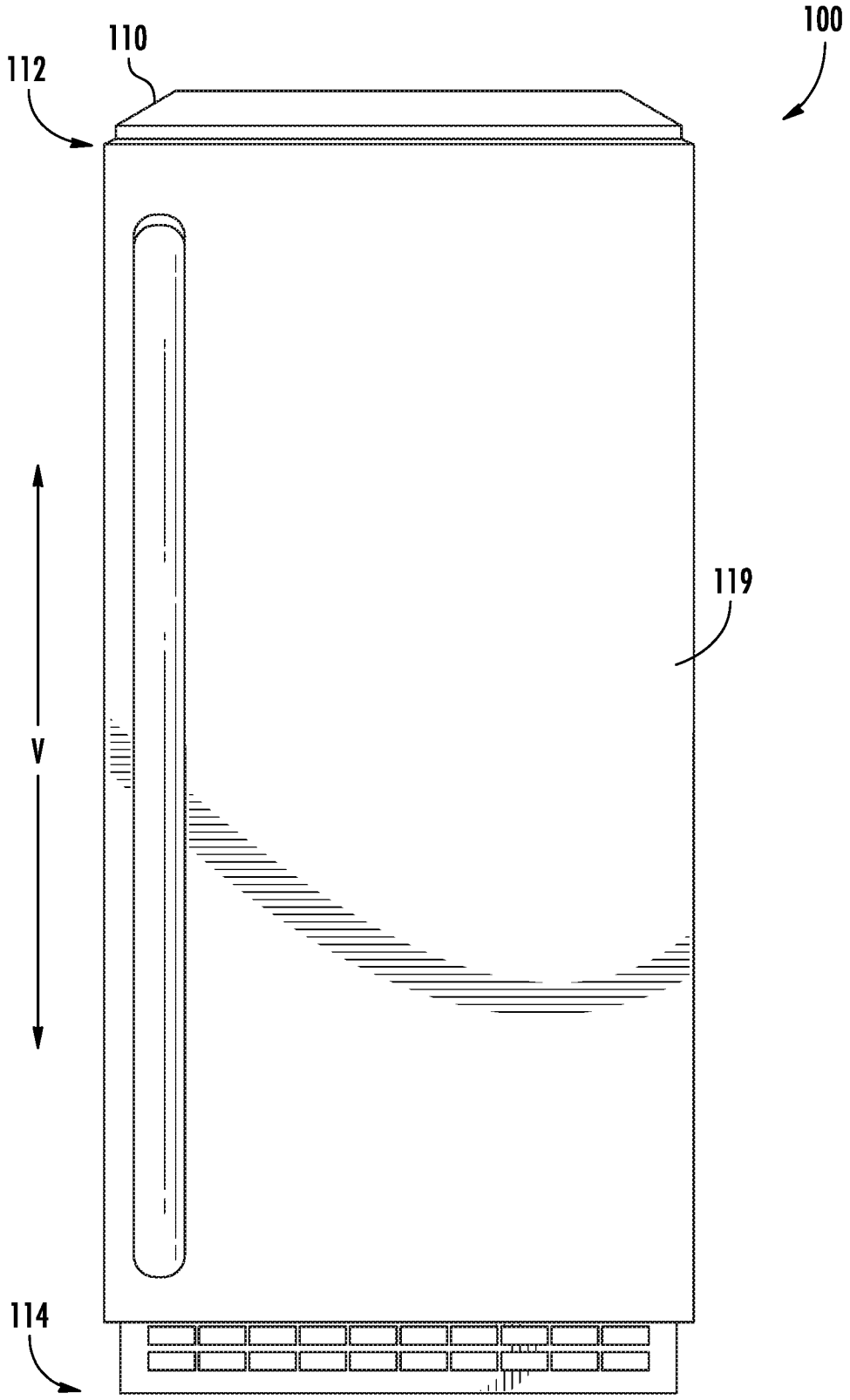
FIG. 1 provides a front, perspective view of an icemaker appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
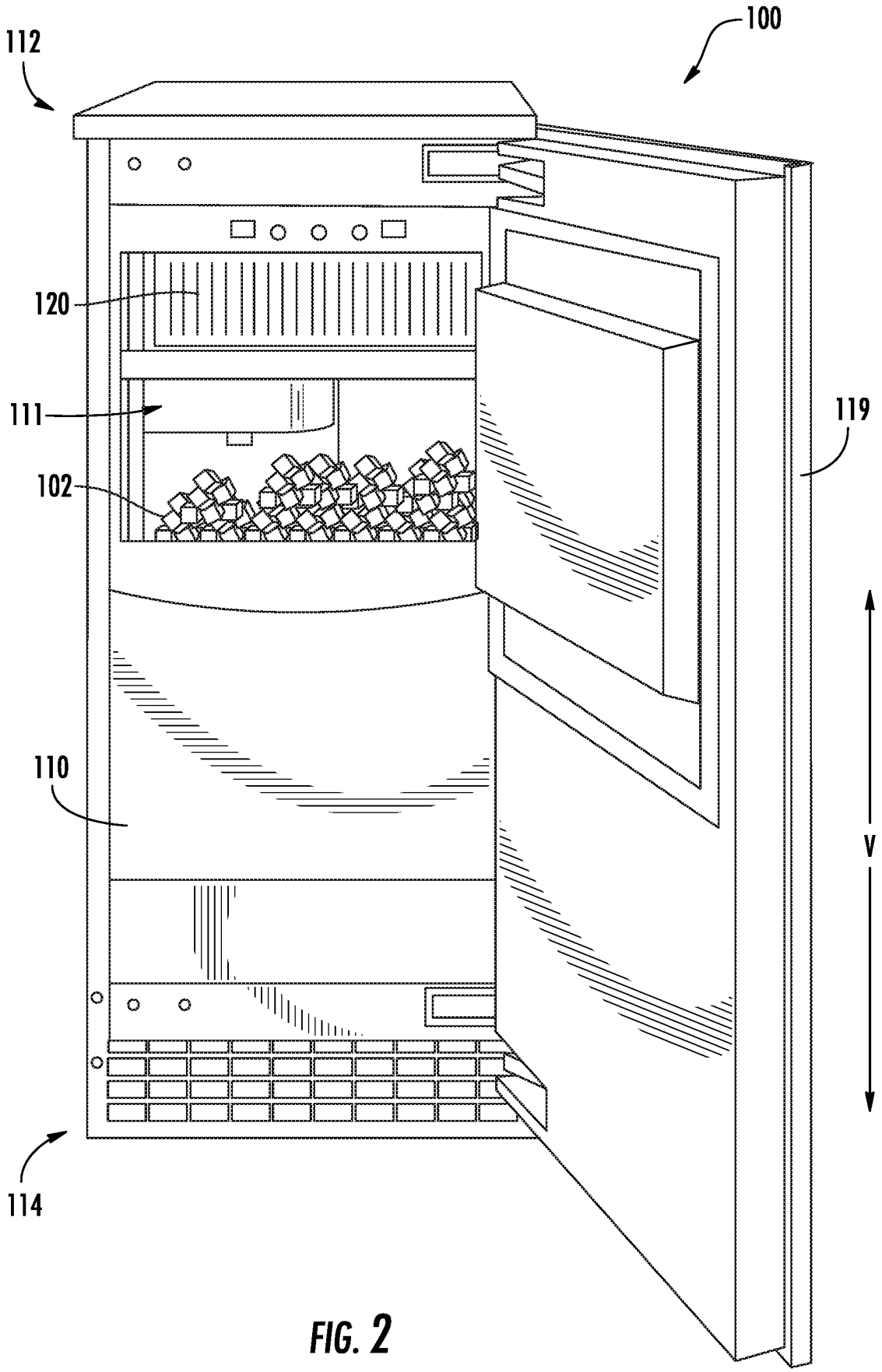
FIG. 2 provides a front, perspective view of the exemplary icemaker appliance of FIG. 1 with a door of the icemaker appliance shown in an open position.

FIGS. 1 and 2 provide front, perspective views of an icemaker appliance 100 according to an example embodiment of the present subject matter. As discussed in greater detail below, icemaker appliance 100 includes features for generating or producing clear ice. Thus, a user of icemaker appliance 100 may consume clear ice stored within icemaker appliance 100. As may be seen in FIG. 1, icemaker appliance 100 defines a vertical direction V.

Icemaker appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door between the open and closed positions to access interior volume 111 of cabinet 110.

As may be seen in FIG. 2, various components of icemaker appliance 100 are positioned within interior volume 111 of cabinet 110. In particular, icemaker appliance 100 includes an ice maker 120 disposed within interior volume 111 of cabinet 110, e.g., at top portion 112 of cabinet 110. Ice maker 120 is configured for producing clear ice. Ice maker 120 may be configured for making any suitable type of clear ice. Thus, e.g., ice maker 120 may be a clear cube ice maker, as would be understood.

Icemaker appliance 100 may also include an ice storage compartment or storage bin 102. Ice storage compartment 102 may be provided within interior volume 111 of cabinet 110. In particular, ice storage compartment 102 may be positioned, e.g., directly, below ice maker 120 along the vertical direction V. Thus, ice storage compartment 102 is positioned for receiving clear ice from ice maker 120 and is configured for storing the clear ice therein. It will be understood that ice storage compartment 102 may be maintained at a temperature greater than the freezing point of water. Thus, the clear ice within ice storage compartment 102 may melt over time while stored within ice storage compartment 102. Icemaker appliance 100 may include features for recirculating liquid meltwater from ice storage compartment 102 to ice maker 120.

Figure 6:
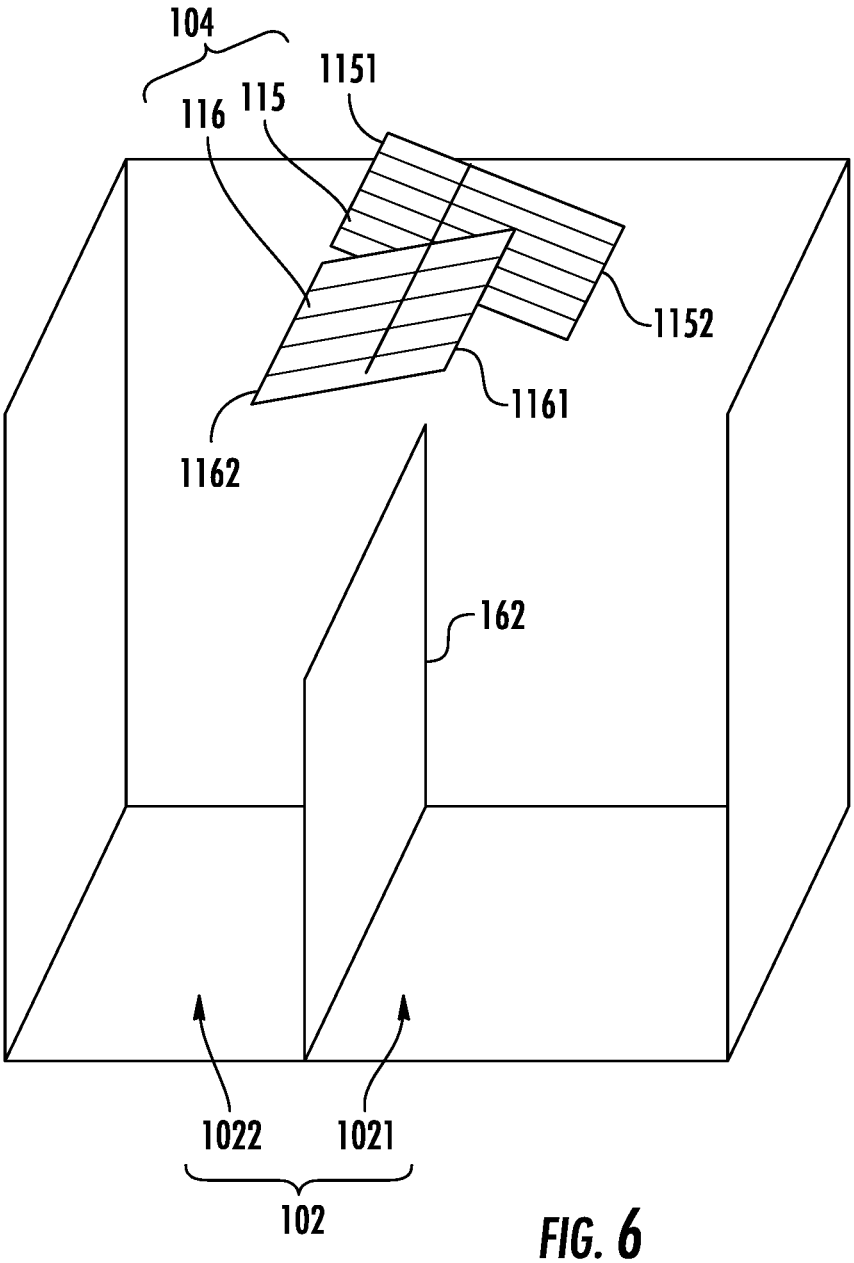
FIG. 6 provides a perspective schematic view of an ice storage compartment according to the exemplary icemaker appliance of FIG. 1.

Referring briefly to FIG. 6, ice storage compartment 102 may include a first ice storage compartment 1021 and a second ice storage compartment 1022. For instance, a compartment divider 162 may be provided within ice storage compartment 102. Compartment divider 162 may demarcate ice storage compartment 102 into first ice storage compartment 1021 and second ice storage compartment 1022. In detail, compartment divider 162 may be a planar wall removably inserted within interior volume 111 of ice storage compartment 102. In some embodiments, as shown in FIG. 6 for example, compartment divider 162 may extend along the transverse direction T from a front of ice storage compartment 102 to a rear of ice storage compartment 102. However, an orientation of compartment divider 162 may vary according to specific embodiments. As will be described in more detail below, first ice storage compartment 1021 may store a first ice (e.g., a first style of ice) and second ice storage compartment 1022 may store a second ice (e.g., a second style of ice).

Figure 3:
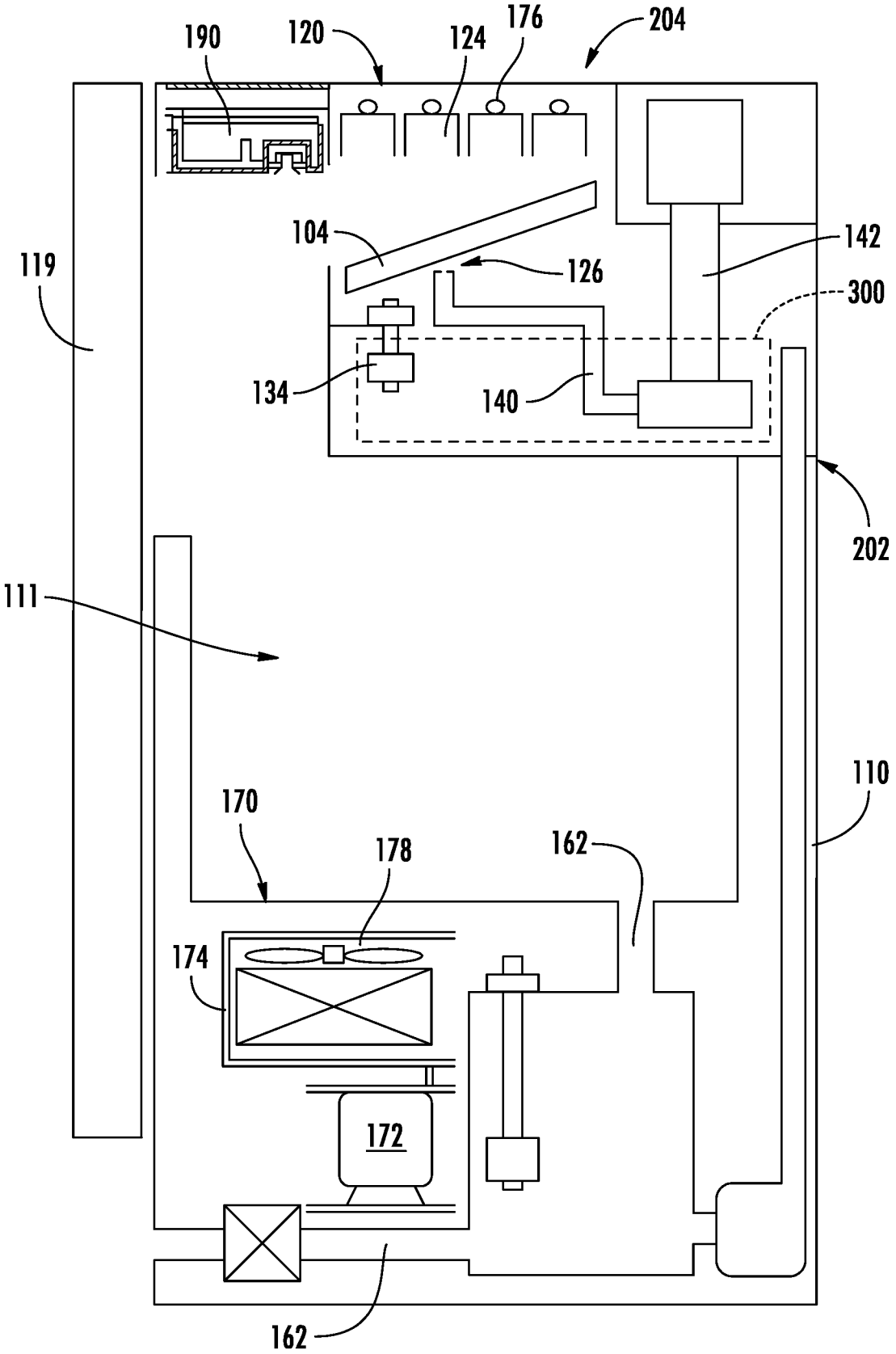
FIG. 3 provides a side, schematic view of certain components of the exemplary icemaker appliance of FIG. 1.

FIG. 3 provides a schematic view of certain components of icemaker appliance 100. As may be seen in FIG. 3, ice maker 120 may include an ice mold 124 and a nozzle 126. For instance, ice mold 124 may include a plurality of ice molds for forming a plurality of ice cubes at one time. Liquid from nozzle 126 may be dispensed toward ice mold 124. For example, nozzle 126 may be provided below ice mold 124 within a first reservoir 128 and may dispense liquid water upward toward ice mold 124. As discussed in greater detail below, ice mold 124 is cooled by refrigerant. Thus, the liquid water from nozzle 126 flowing across ice mold 124 may freeze on ice mold 124, e.g., in order to form clear ice cubes on ice mold 124. Further, as described below, ice mold 124 may include a plurality of first ice molds 1241 and a plurality of second ice molds 1242.

To cool ice mold 124, icemaker assembly 100 includes a sealed system 170. Sealed system 170 includes components for executing a known vapor compression cycle for cooling ice maker 120 and/or air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Additionally or alternatively, the placement of the components (e.g., compressor 172, condenser 174, etc.) may be adjusted according to specific embodiments. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. Evaporator 176 is positioned at and in thermal contact with ice maker 120, e.g., at ice mold 124 of ice maker 120. Thus, ice maker 120 may be directly cooled with refrigerant at evaporator 176.

It should be understood that ice maker 120 may be an air-cooled ice maker in alternative example embodiments. Thus, e.g., cooled air from evaporator 176 may refrigerate various components of icemaker appliance 100, such as ice mold 124 of ice maker 120. In such example embodiments, evaporator 176 is a type of heat exchanger which transfers heat from air passing over evaporator 176 to refrigerant flowing through evaporator 176, and fan may circulate chilled air from the evaporator 176 to ice maker 120.

In some embodiments, icemaker appliance 100 may further include a cleanout line 162. Cleanout line 162 may include an additional reservoir (e.g., a third reservoir) which may collect meltwater from ice storage compartment 102. In one example, cleanout line 162 is connected directly to ice storage compartment 102. Accordingly, liquid within ice storage compartment 102 may flow out of ice storage compartment 102 through cleanout line 162. A second end of cleanout line 162 may be exposed outside of icemaker appliance 100. Liquid flowing through cleanout line 162 may be released from icemaking appliance 100 via the second end. In other embodiments, liquid flowing through cleanout line 162 may be resupplied to first reservoir 128. In still other embodiments, cleanout line 162 may be omitted entirely, such that icemaker appliance 100 is drainless.

Icemaker appliance 100 may also include a controller 190 that regulates or operates various components of icemaker appliance 100. Controller 190 may include a memory and one or more microprocessors, CPUs or the like, such as general or special purpose microprocessors operable to execute programming instructions or micro-control code associated with operation of icemaker appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of icemaker appliance 100. As an example, the various operational components of icemaker appliance 100 may be in communication with controller 190 via one or more signal lines or shared communication busses.

Icemaker appliance 100 may include first reservoir 128. First reservoir 128 may be provided within ice storage compartment 102. For example, first reservoir 128 may be located at or near top portion 112 of interior volume 111 of ice storage compartment 102. First reservoir 128 may define a receiving space that holds liquid (e.g., water) to be formed into ice. For example, an inner volume of first reservoir 128 may be smaller than interior volume 111 of ice storage compartment 102. In some embodiments, first reservoir 128 may hold other liquids, such as cleaning solutions, for example.

Ice maker 120 may be provided within first reservoir 128. In detail, evaporator 176 and ice mold 124 may be located within first reservoir 128. In some embodiments, ice maker 120 is provided above first reservoir 128 (e.g., along the vertical direction V). First reservoir 128 may extend along the vertical direction V from a bottom end 202 to a top end 204. Ice maker 120 may be mounted at the top end 204 of the first reservoir 128. For example, evaporator 176 may be mounted to the top end 204 and ice mold 124 may be connected to evaporator 176. In some embodiments, ice mold 124 may be defined by evaporator 176. In other words, evaporator 176 is integral with ice mold 124 such that the clear ice is formed directly on evaporator 176.

Icemaker appliance 100 may include a first circulation system 139. First circulation system 139 may include a first pump 142, a first circulation conduit 140, and a first nozzle 126. First pump 142 may be provided within first reservoir 128. First pump 142 may pump water or liquid stored in first reservoir 128. First circulation conduit 140 may be connected to first pump 142 such that the water or liquid pumped by first pump 142 is circulated through first circulation conduit 140. First circulation conduit 140 may include a series of tubes or pipes capable of guiding the water or liquid pumped by first pump 142. First nozzle 126 may be provided at a downstream end of first circulation conduit 140. First nozzle 126 may dispense the water or liquid stored in first reservoir 128 toward ice maker 120 (i.e., ice mold 124 and/or evaporator 176).

In one embodiment, first nozzle 126 may be located near bottom end 202 of first reservoir 128. As such, the water or liquid may be sprayed in a generally upward direction from first nozzle 126 toward ice maker 120. Accordingly, clear ice may be formed on ice maker 120 due to a constant spray of water onto ice maker 120 while ice maker is cooled by a circulation of refrigerant through sealed system 170. In detail, liquid dispensed from first nozzle 126 may be directed toward the plurality of first ice molds 1241. In some embodiments, a plurality of first nozzles 126 may be provided. Each of the plurality of first nozzles 126 may be connected to first pump 142 independently (e.g., each first nozzle 126 having a dedicated first circulation conduit 140). Additionally or alternatively, each of the plurality of first nozzles 126 may be connected to the first pump 142 via a joint circulation conduit.

Icemaker appliance 100 may also be operated in a cleaning mode, or may perform a cleaning operation to clean the various pieces in icemaker appliance 100 that may become contaminated with foreign debris. For example, in some embodiments, cleaning solution or acid may be pumped through first circulation conduit 140 and dispensed by nozzle 126 toward ice maker 120. Accordingly, the cleaning solution or acid may remove the foreign contaminants or debris from, for example, ice mold 124, nozzle 126, first reservoir 128, and first circulation conduit 140.

A first liquid level sensor or switch 134 may be provided in first reservoir 128. Generally, the first liquid level sensor 134 may sense a level of liquid contained within first reservoir 128. In some embodiments, first liquid level sensor 134 is in operable communication with controller 190. For instance, first liquid level sensor 134 may communicate with the controller 190 via one or more signals. In certain embodiments, first liquid level sensor 134 includes a predetermined threshold level (e.g., to indicate the need for additional liquid to first reservoir 128). In particular, first liquid level sensor 134 may detect if or when the liquid first reservoir 128 is below the predetermined threshold level. Optionally, first liquid level sensor 134 may be a two-position sensor. In other words, first liquid level sensor 134 may either be "on" or "off," depending on a level of liquid.

For example, when the liquid level is below the predetermined threshold level, first liquid level sensor 134 is "off," meaning it does not send a signal to first pump 142 via controller 190 to pump liquid from first reservoir 128 through first circulation conduit 140 toward first nozzle 126. For another example, when the liquid level is above the predetermined threshold, first liquid level sensor 134 is "on," meaning it sends a signal to first pump 142 via controller 190 to operate first pump 142 to pump liquid through first circulation conduit 140 toward first nozzle 126. It should be understood that first liquid level sensor 134 may be any suitable sensor capable of determining a level of liquid within first reservoir 128, and the disclosure is not limited to those examples provided herein.

In some embodiments, a filter (not shown) may be connected to first circulation conduit 140. The filter may filter out solid contaminants from water in the first reservoir 128. The filter may be provided downstream from first pump 142.

Additionally or alternatively, the filter may be provided upstream from nozzle 126. In some such embodiments, the filter is provided along a flow path between first pump 142 and nozzle 126, such that water passes from first reservoir 142 through the filter before being dispensed by nozzle 126. The filter may include a filter medium which performs the actual filtration. For example, the filter medium may be a deionization filter. Nonetheless, it should be understood that various additional or alternative suitable filter mediums or devices may be incorporated as the filter medium, or the filter may be omitted entirely.

Figure 5:
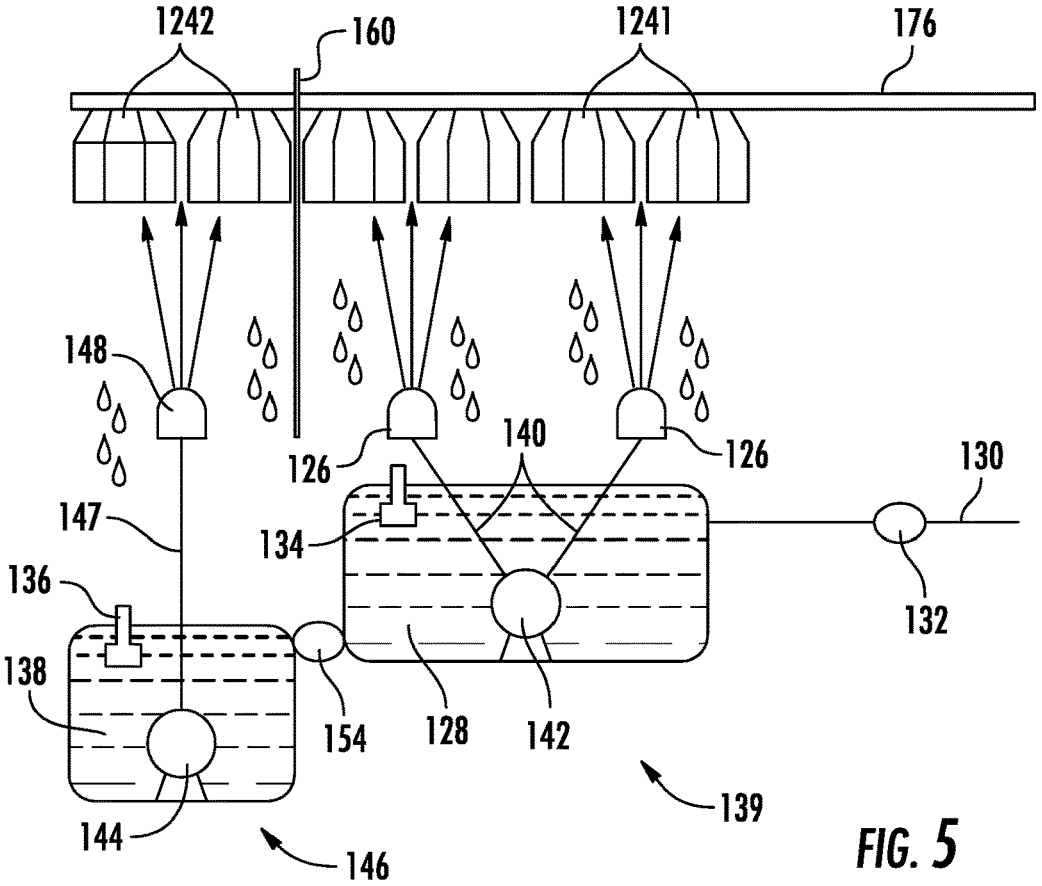
FIG. 5 provides a side schematic view of a plurality of ice molds and first and second reservoirs according to the exemplary icemaker appliance of FIG. 1.

Referring briefly to FIG. 5, icemaker appliance 100 may include a second reservoir 138. Second reservoir 138 may be provided within ice storage compartment 102. For example, second reservoir 138 may be immediately adjacent to first reservoir 128. Second reservoir 138 may define a receiving space that holds water to be formed into ice. For example, an inner volume of second reservoir 138 may be smaller than interior volume 111 of ice storage compartment 102. In some embodiments, second reservoir 138 may hold other liquids, such as cleaning solutions, for example. Second reservoir 138 may be in fluid communication with first reservoir 128. For instance, liquid contained within first reservoir 128 may be selectively diverted to second reservoir 138. Second reservoir 138 may be lower than first reservoir 128 (e.g., along the vertical direction V). In detail, a bottom of second reservoir 138 may be lower than a bottom of first reservoir 128 along the vertical direction V. Additionally or alternatively, a top of second reservoir 138 may be lower than a top of first reservoir 128 (e.g., along the vertical direction).

First reservoir 128 and second reservoir 138 may be connected by a conduit 154. Conduit 154 may be a pipe or duct allowing liquid to flow from first reservoir 128 into second reservoir 138. Conduit 154 may be any suitable length, and the disclosure is not limited in size or material used. Additionally or alternatively, a valve 156 may be provided on conduit 154. For instance, valve 156 may allow conduit 154 to be selectively opened and closed. Valve 156 may receive input signals from controller 190 to selectively open and close to allow liquid from first reservoir 128 to pass through conduit 154 into second reservoir 138. In some embodiments, valve 156 is connected directly to first reservoir 128 and second reservoir 138 (e.g., without conduit 154). In this case, conduit 154 may be omitted. Further, valve 156 may be any suitable type of valve, such as a check valve, a gate valve, a flap valve, a ball valve, an electronic valve, or the like. In some embodiments, valve 156 is a mechanical valve (i.e., valve 156 may open and close according to a liquid pressure from first reservoir 128, without electronic intervention from controller 190). In still other embodiments, valve 156 is omitted. Accordingly, liquid from first reservoir 128 may spill into second reservoir 138 over a lip of first reservoir 128, for instance.

In detail, icemaker appliance 100 may receive a level of water (e.g., municipal water) into first reservoir 128. Icemaker appliance 100 may then perform a first icemaking cycle or operation, forming clear ice. The leftover water remaining within first reservoir 128 may contain levels of total dissolved solids (TDS) above a level permitted for forming clear ice. Accordingly, controller 190 may open valve 156 to allow the water in first reservoir 128 to flow into second reservoir 138. A second icemaking process may then be initiated from second reservoir 138. In some instances, the ice formed in the second icemaking process may form cloudy ice (e.g., containing a certain level of TDS).

According to some embodiments, the liquid in first reservoir 128 may be selectively transferred to second reservoir 138 according to a detected level of TDS. In detail, liquid (e.g., water) supplied to first reservoir 128 (e.g., via water supply conduit 130) may have a first predetermined concentration of TDS. The first concentration of TDS may be between about 100 parts per million (ppm) and about 200 ppm, for example. As discussed above, throughout the icemaking cycle by first circulation system 139, the concentration of TDS may increase within first reservoir 128. Accordingly, liquid level sensor 134 may additionally or alternatively detect or sense a level of TDS of the liquid within first reservoir 128, e.g., at predetermined time intervals. Upon detecting the TDS level to be above a predetermined concentration level via sensor 134, controller 190 may instruct valve 156 to open to allow the liquid within first reservoir 128 to transfer to second reservoir 138. For instance, the predetermined TDS level may be between about 280 ppm and about 350 ppm. In one example, the predetermined TDS level is about 300 ppm. Thus, the liquid from first reservoir 128 may be selectively transferred to second reservoir 138 according to a detected TDS concentration level.

Icemaker appliance 100 may include a second circulation system 146. Second circulation system 146 may be provided in second reservoir 138. For instance, second circulation system 146 may include a second pump 144, a second circulation conduit 147, and a second nozzle 148. Second circulation system 146 may operate along the same principles as first circulation system 139. For instance, second pump 144 may pump liquid from second reservoir 138 through second conduit 147 toward second nozzle 148. However, second nozzle 148 may direct liquid toward the plurality of second ice molds 1242 as opposed to the plurality of first ice molds 1421. In some embodiments, a plurality of second nozzles 148 may be provided. Each of the plurality of second nozzles 148 may be connected to second pump 144 independently (e.g., each second nozzle 148 having a dedicated second circulation conduit 147). Additionally or alternatively, each of the plurality of second nozzles 148 may be connected to the second pump 144 via a joint circulation conduit.

In some embodiments, first reservoir 128, first ice mold 1241, and first circulation system 139 may collectively be referred to as a first icemaker. Similarly, second reservoir 138, second ice mold 1242, and second circulation system 146 may collectively be referred to as a second icemaker. As will be described in more detail below, second icemaker may not include second circulation system 146.

A second liquid level sensor 136 may be provided in second reservoir 138. Generally, the second liquid level sensor 136 may sense a level of liquid contained within second reservoir 138. In some embodiments, second liquid level sensor 136 is in operable communication with controller 190. For instance, second liquid level sensor 136 may communicate with the controller 190 via one or more signals. In certain embodiments, second liquid level sensor 136 includes a predetermined threshold level (e.g., to indicate the need for additional liquid to second reservoir 138). In particular, second liquid level sensor 136 may detect if or when the liquid second reservoir 138 is below the predetermined threshold level. Optionally, second liquid level sensor 136 may be a two-position sensor. In other words, second liquid level sensor 136 may either be "on" or "off," depending on a level of liquid. For example, when the liquid level is below the predetermined threshold level, second liquid level sensor 136 is "off," meaning it does not send a signal to second pump 144 via controller 190 to pump liquid from second reservoir 138 through second circulation conduit 147 toward second nozzle 148. For another example, when the liquid level is above the predetermined threshold, second liquid level sensor 136 is "on," meaning it sends a signal to second pump 144 via controller 190 to operate second pump 144 to pump liquid through second circulation conduit 147 toward second nozzle 148. It should be understood that second liquid level sensor 136 may be any suitable sensor capable of determining a level of liquid within second reservoir 138, and the disclosure is not limited to those examples provided herein.

A perforated ramp or series of slats 104 may be provided above the first reservoir 128 (e.g., along the vertical direction V). The ramp 104 may be located beneath the ice maker 120 (e.g., beneath the ice mold 124 or evaporator 176). In other words, ramp 104 may be located under ice maker 120 along the vertical direction V. A top surface of the ramp 104 (or top edges of the series of slats) may be angled. In other words, a first end of ramp 104 may be positioned higher in the vertical direction V than a second end of ramp 104. Thus, when ice is formed on ice maker 120 and harvested, the ice may fall onto ramp 104 and slide into ice storage compartment 102. In one example, as seen in FIG. 3, the ramp 104 is angled downward toward a front of cabinet 110. Accordingly, a passageway or hole may be provided on a side of first reservoir 128 through which the ice cubes may be ejected after sliding down ramp 104.

Additionally or alternatively, referring briefly to FIG. 6, ramp 104 may be divided into a first ramp 115 and a second ramp 116. In some embodiments, first ramp 115 is a separate ramp from second ramp 116. First ramp 115 may be associated with the plurality of first ice molds 1241 and second ramp 116 may be associated with the plurality of second ice molds 1242. Accordingly, first ramp 115 may be angled in a first direction while second ramp 116 may be angled in a second direction. For instance, first ramp 115 may have a first lateral end 1151 provided higher (e.g., along the vertical direction V) than a second lateral end 1152 of first ramp 115. When viewed from the front (i.e., as shown in FIG. 6), first lateral end 1151 may be provided closer to a left side of ice storage compartment 102 than second lateral end 1152. Further, second ramp 116 may have a first lateral end 1161 provided higher (e.g., along the vertical direction V) than a second lateral end 1162 of second ramp 116. When viewed from the front (i.e., as shown in FIG. 6), first lateral end 1161 may be provided closer to a right side of ice storage compartment 102 than second lateral end 1162. It should be noted that these specific orientations are by way of example only, and that first ramp 115 and second ramp 116 may be angled in any appropriate directions.

The ice maker 102 may further include a heater (not shown) provided at or near ice mold 124. During a harvesting of the ice cubes formed on ice mold 124, the heater may be activated to heat ice mold 124 and subsequently release the ice cubes from ice mold 124. In one embodiment, the sealed system 170 may be turned off (i.e., no refrigerant is supplied to evaporator 176) and the heater may be turned on for a predetermined amount of time. Ice mold 124 is then temporarily heated by the heater to release or harvest the ice cubes. The heater may be an electric heater, for example. However, it should be understood that various types of heaters may be used to heat ice mold 124, including a reverse flow of refrigerant or a hot gas bypass through sealed system 170, for another example, and the disclosure is not limited to those examples provided herein.

Figure 4:
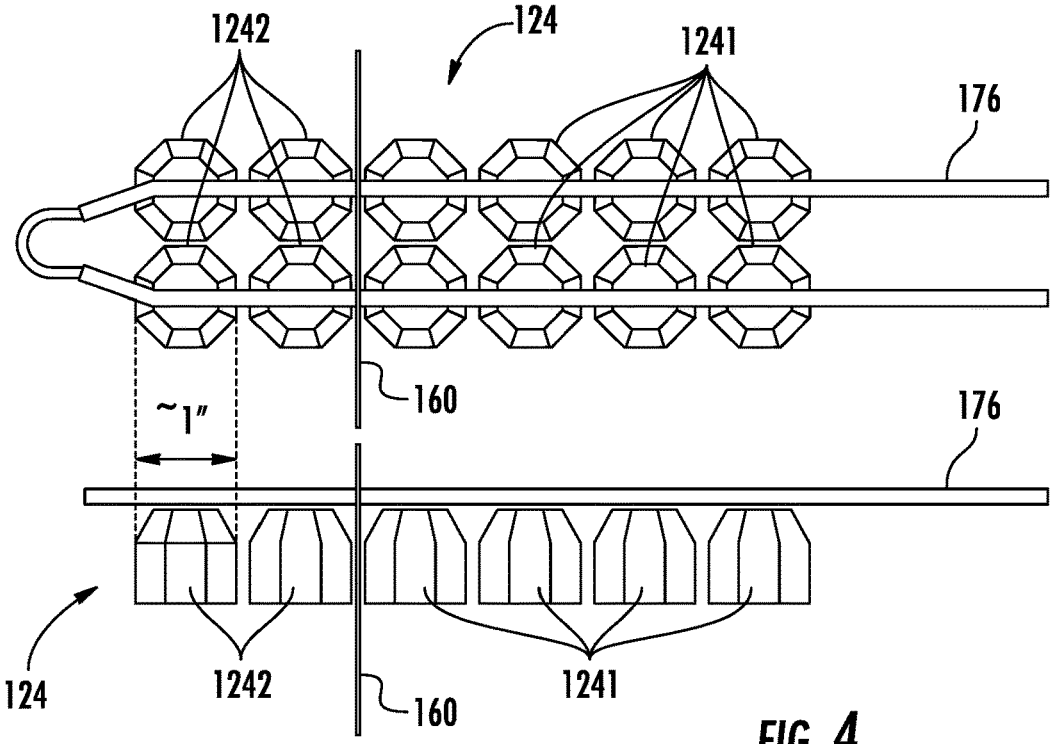
FIG. 4 provides top and side schematic views of a plurality of ice molds according to the exemplary icemaker appliance of FIG. 1.

FIG. 4 provides top and side schematic views of ice maker 120, and FIG. 5 provides a side schematic view of ice maker 120 including ice molds 124, as well as first reservoir 128 and second reservoir 138. For example, first reservoir 128 and second reservoir 138 may be located within inset 300 of FIG. 3. Referring to FIG. 4, ice maker 120 may include ice molds 124. Additionally or alternatively, evaporator 176 may be attached to ice molds 124. Ice molds 124 may include the plurality of first ice molds 1241 and the plurality of second ice molds 1242. The plurality of first ice molds 1241 may be distinguished from the plurality of second ice molds 1242 along the transverse direction T, in one example. For instance, the plurality of first ice molds 1241 may be located proximate a rear of cabinet 110 and the plurality of second ice molds 1242 may be located proximate a front of cabinet 110. It should be noted that the locations of the plurality of first ice molds 1241 and the plurality of second ice molds 1242 are provided by way of example only, and that the locations thereof may be altered according to specific embodiments.

A divider 160 may be positioned between the plurality of first ice molds 1241 and the plurality of second ice molds 1242. For example, divider 160 may extend along the vertical direction V and along the lateral direction L. Divider 160 may prevent liquid supplied from first nozzle 126 from contacting the plurality of second ice molds 1242 and may prevent liquid supplied from second nozzle 136 from contacting the plurality of first ice molds 1241. Additionally or alternatively, divider 160 may prevent ice formed on the plurality of first ice molds 1241 from falling into second ice storage compartment 1022 and may prevent ice formed on the plurality of second ice molds 1242 from falling into first ice storage compartment 1021. Thus, divider 160 may be positioned to divide the plurality of first ice molds 1241 and the plurality of second ice molds 1242. In one example, as shown in FIG. 4, the plurality of first ice molds 1241 may include eight ice molds 124 and the plurality of second ice molds 1242 may include four ice molds 124. However, the division of ice molds 124 may vary according to specific embodiments.

Figure 7:
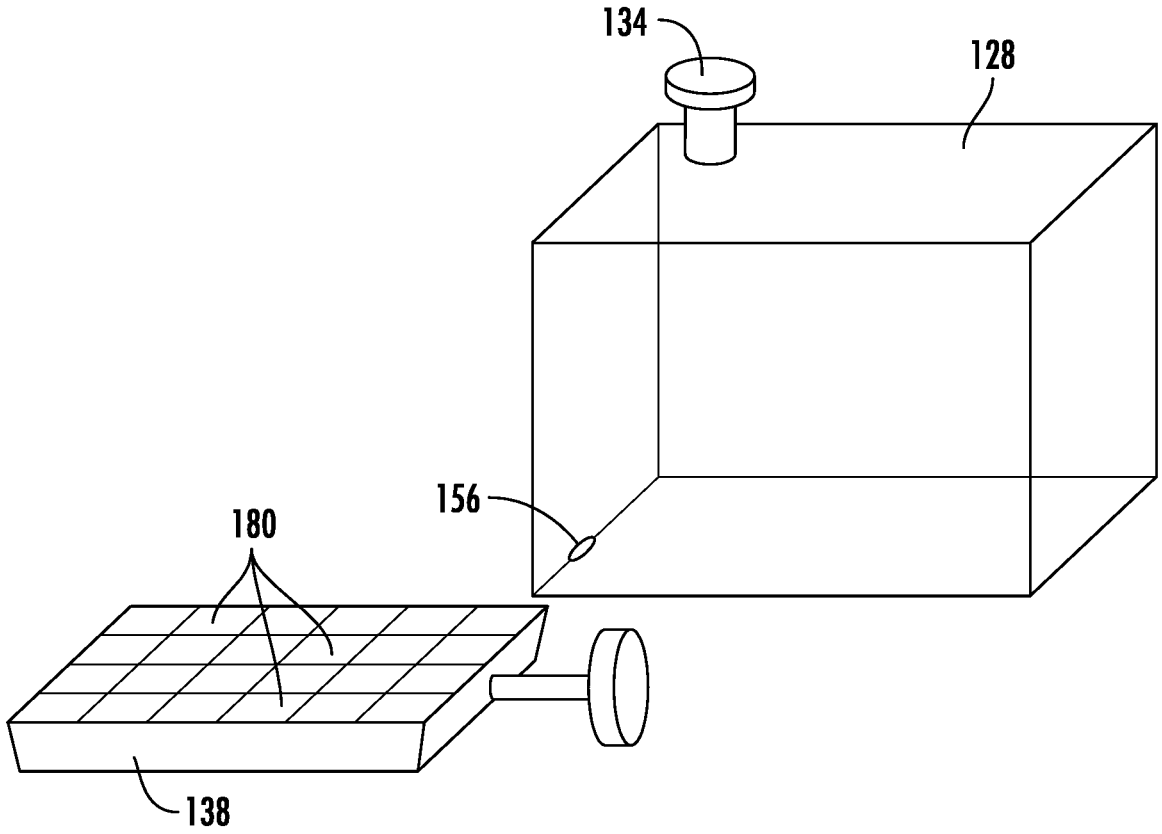
FIG. 7 provides a perspective schematic view of a first and second reservoir according to another exemplary embodiment of the icemaker appliance of FIG. 1.

Referring now to FIG. 7, another embodiment of icemaker appliance 100 will be described in detail. Certain elements described above with reference to FIGS. 1 through 6 are similarly incorporated, and as such a detailed description thereof will be foregone for the sake of brevity. With reference now to FIG. 7, second reservoir 138 may be divided into a plurality of pockets 180. For example, second reservoir 138 may be an ice tray in which liquid supplied from first reservoir 128 may be frozen into cubes (e.g., ice cubes). According to this embodiment, first reservoir 128 may include first circulation system 139. However, second circulation system 146 may be omitted.

Liquid supplied to first reservoir 128 may be pumped by first pump 142 through first circulation conduit 140 to first nozzle 126, where it is selectively supplied to ice mold 124. After an ice generating operation (e.g., where the liquid is supplied to ice mold 124) is completed, the leftover liquid within first reservoir 128 may be supplied to second reservoir 138 (e.g., into pockets 180). In some embodiments, second reservoir 138 may be rotatably provided. For instance, second reservoir 138 may be attached within icemaker appliance 100 so as to be selectively rotated (e.g., about an axis defined along the lateral direction L or transverse direction T). Accordingly, ice formed within pockets 180 may be released into ice storage compartment 102 (e.g., second ice storage compartment 1022).

Icemaker appliance 100 may include a water supply conduit 130 and a supply valve 132. Water supply conduit 130 is connectable to an external pressurized water supply, such as a municipal water supply or well. Supply valve 132 may be coupled to water supply conduit 130, and supply valve 132 may be operable (e.g., openable and closable) to regulate liquid water flow through water supply conduit 130 into icemaker appliance 100. In one embodiment, water supply conduit 130 is connected to first reservoir 128. In detail, water supply conduit 130 is in fluid communication with first reservoir 128 to allow external water to be supplied into first reservoir 128 via water supply conduit 130. Thus, e.g., first reservoir 128 may be filled with fresh liquid water from the external pressurized water supply through water supply conduit 130 by opening supply valve 132. Water supply conduit 130 may be connected at a bottom of cabinet 110. In some embodiments, water supply conduit 130 is connected at a top of cabinet 110. According to this embodiment, water introduced through a top of the cabinet may be released over top of ice maker 120 and may assist in a harvesting operation of ice formed on ice mold 124.

As mentioned above, the plurality of first ice molds 1241 may be configured to generate a first ice style and the plurality of second ice molds may be configured to generate a second ice style. In some examples, the plurality of first ice molds 1241 generates clear ice. In detail, liquid (e.g., water) supplied to the icemaker appliance 100 may contain a certain level of dissolved solids, or total dissolved solids (TDS). When the concentration of TDS within the liquid supplied to the plurality of first ice molds 1241 is below a certain level, impurities generating cloudiness within the ice may not be frozen within the cubes, and clear ice may not be formed. The leftover liquid from this operation may contain a higher concentration or level of TDS. This liquid may then be supplied to second reservoir 138 instead of being drained out of icemaker appliance 100. Accordingly, the liquid supplied to the plurality of second ice molds 1242 may contain a higher concentration of TDS (e.g., in at least one operation). The ice then generated on the plurality of second ice molds may be cloudy ice, or potentially nugget ice. The cloudy ice may be stored separately from the clear ice (e.g., in second ice storage compartment 1022 as opposed to first ice storage compartment 1021). A user may then use the clear ice for drinks and consumption and the cloudy ice for coolers or ice bags.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance defining a vertical direction, a lateral direction, and a transverse direction, the icemaker appliance comprising:

a cabinet comprising an ice storage compartment defined therein;

a first ice mold and a second ice mold provided above the ice storage compartment;

a first reservoir provided within the ice storage compartment;

a first circulation system provided in the first reservoir, the first circulation system configured for supplying a first liquid from the first reservoir to the first ice mold during a first icemaking cycle, the first liquid containing a first concentration of total dissolved solids (TDS);

a second reservoir provided within the ice storage compartment, the second reservoir being in fluid communication with the first reservoir; and a second circulation system provided in the second reservoir, the second circulation system configured for supplying a second liquid from the second reservoir to the second ice mold during a second icemaking cycle, the second liquid containing a second concentration of TDS greater than the first level of TDS, wherein the second liquid comprises at least a portion of the first liquid transferred to the second reservoir after the first icemaking cycle.

2. The icemaker appliance of claim 1, wherein the first circulation system comprises:

a first circulation conduit;

a first pump connected to the first circulation conduit to pump the liquid from the first reservoir through the first circulation conduit; and a nozzle downstream from the first circulation conduit to dispense the liquid from the first circulation conduit toward the first ice mold.

3. The icemaker appliance of claim 1, wherein the second circulation system comprises:

a second circulation conduit;

a second pump connected to the second circulation conduit to pump the liquid from the second reservoir through the second circulation conduit; and a nozzle downstream from the second circulation conduit to dispense the liquid from the second circulation conduit toward the second ice mold.

4. The icemaker appliance of claim 1, wherein the second reservoir is lower than the first reservoir along the vertical direction.

5. The icemaker appliance of claim 4, further comprising a valve provided between the first reservoir and the second reservoir, the valve selectively allowing the liquid to flow from the first reservoir to the second reservoir.

6. The icemaker appliance of claim 1, wherein the ice storage compartment is partitioned into a first ice storage compartment and a second ice storage compartment.

7. The icemaker appliance of claim 6, wherein the first ice mold comprises a plurality of first ice molds and the second ice mold comprises a plurality of second ice molds, and wherein ice formed from the plurality of first ice molds is directed into the first ice storage compartment and ice formed from the plurality of second ice molds is directed into the second ice storage compartment.

8. The icemaker appliance of claim 1, wherein the ice maker comprises a sealed cooling system in communication with the first and second ice molds, the sealed cooling system having an evaporator positioned at the first and second ice molds.

9. The icemaker appliance of claim 1, further comprising a supply conduit and a supply valve, the supply conduit connectable to an external liquid supply, the supply valve connected to the supply conduit to regulate a liquid flow through the supply conduit into the icemaker appliance.

10. The icemaker appliance of claim 9, wherein the supply conduit is in fluid communication with the first reservoir such that the liquid flow from the external liquid supply is supplied to the first reservoir.

* * * * *